US010872590B1

(12) United States Patent
Salisbury

(10) Patent No.: US 10,872,590 B1
(45) Date of Patent: Dec. 22, 2020

(54) FOOT STOMP WITH IMPROVED ACOUSTICS AND STABILITY

(71) Applicant: Christian Salisbury, Nevada City, CA (US)

(72) Inventor: Christian Salisbury, Nevada City, CA (US)

(73) Assignee: Christian A. Salisbury, Nevada City, CA (US)

( * ) Notice: Subject to any disclaimer, the term of this patent is extended or adjusted under 35 U.S.C. 154(b) by 0 days.

(21) Appl. No.: 16/667,625

(22) Filed: Oct. 29, 2019

(51) Int. Cl.

| | |
|---|---|
| ***G10H 3/12*** | (2006.01) |
| ***G10H 3/26*** | (2006.01) |
| ***G10D 13/08*** | (2020.01) |
| *G10D 13/02* | (2020.01) |

(52) U.S. Cl.
CPC ..... *G10H 3/26* (2013.01); *G10D 13/08* (2013.01); *G10D 13/02* (2013.01); *G10H 2220/525* (2013.01)

(58) Field of Classification Search
CPC ..... G10H 1/0091; G10H 3/146; G10H 2220/525; G10H 2220/561; G10H 3/00; G10H 1/00; G10H 2210/071; G10H 2210/361; G10H 2230/275; G10H 2230/281; G10H 3/143; G01L 1/16; G10G 7/005
See application file for complete search history.

(56) References Cited

U.S. PATENT DOCUMENTS

| | | | | |
|---|---|---|---|---|
| 9,711,122 | B1 * | 7/2017 | Van Pelt | G10D 13/08 |
| 10,395,630 | B1 * | 8/2019 | Greenlee | G10H 1/0551 |
| 2004/0184634 | A1 * | 9/2004 | Nastasic | A63J 5/04 381/361 |
| 2014/0013930 | A1 * | 1/2014 | Dahl | G10H 1/32 84/730 |
| 2019/0139520 | A1 * | 5/2019 | Floyd | G10H 3/146 |

FOREIGN PATENT DOCUMENTS

GB 2527027 A 12/2015

* cited by examiner

*Primary Examiner* — Marlon T Fletcher
(74) *Attorney, Agent, or Firm* — Lowenstein Sandler LLP; Madhumita Datta; Beverly Lamberson

(57) ABSTRACT

A foot stomp percussion device that creates dual tones when stomped on by the musician. The foot stomp comprises a housing comprising a main portion and a bottom ledge portion that extends beyond the main portion to enhance stability. In one embodiment, the main portion of the housing comprises a smaller and shallower cavity containing a piezo transducer and a larger and deeper cavity coupled to a volume potentiometer, as well as one or more electrical outputs to connect the foot stomp to a sound amplification system. The solid back portion of the foot stomp creates a low frequency tone when stomped on, and the front portion containing the larger and deeper cavity creates a high frequency tone when stomped on.

19 Claims, 7 Drawing Sheets

FOOT STOMP WITH IMPROVED ACOUSTICS AND STABILITY

TECHNICAL FIELD

Implementations of the disclosure relate to musical tone control in a percussion instrument known as a foot stomp.

BACKGROUND

It is very important to a musician to be able to create and perform the music he/she envisions. Historically, guitarists, piano players, singers, and other instrumentalist utilized foot tapping and stamping as a percussive, rhythmic accompaniment to their music. Technical limitation of earlier times (early $20^{th}$ century) made these percussive aspects of musicians' performances difficult to be recorded or heard in larger music venues.

Additionally, many musicians struggle to generate a drum beat concurrently with other musical instruments while performing solo or in a small group. The musician(s) may not have the resources to include a drummer in their group, especially if only a handful of songs require a drum beat.

A foot stomp is a useful addition to a musician's musical expression as it allows a musician to keep a drum beat using his/her feet, while singing and/or playing another instrument, for example, a guitar. A foot stomp (alternatively called a stomp box) is a simple percussion instrument, which is a small wooden box placed under the foot, which is tapped or stamped on rhythmically to produce a sound similar to a drum. A foot stomp may have a contact microphone, also known as a pickup, which is a type of microphone that senses audio vibrations through contact with solid objects. Unlike air microphones that transduce air vibrations, contact microphones transduce only structure-borne sound. Piezoelectricity based pickup microphones, sometimes referred to as piezoelectric discs (or piezo discs or simply piezos), are commonly used in foot stomps.

Conventional foot stomps, however, produce one single tone. When the user stomps on the box, conventional instruments usually emit a low frequency bass sound, which may mimic the sound of a bass drum. Pervious foot stomps that have attempted to vary the tonality of the instrument have done so by including more than one piezo discs. However this can often result in a feedback loop created by the electrical components. Furthermore, some conventional foot stomps are built using plastic components, which may create ghost notes when the plastic flexes while the foot stomp is being played (ghost notes can be described as additional sounds not intended by the user). Conventional foot stomps are also created by gluing pieces together, which may cause further ghost notes. Additionally, gluing components, such as a piezo disc, to the foot stomp results in a product that cannot be taken apart without breaking or otherwise damaging the instrument. Furthermore, when played with vigor, conventional foot stomps have a tendency to tip upwards and then hit the ground, interrupting the user's rhythm and compromising the musician's performance.

SUMMARY

Aspects of the disclosure address the above and other deficiencies by providing a foot stomp instrument that allows for full musical expression by enabling the sound generated by percussive foot stamps, or taps, to be recorded and adequately amplified by modern sound reinforcement equipment. The instrument described herein uses a single piezo disc placed between a hollow cavity and a solid unit in order to produce two distinct tones when stomped on. The tones produced by the foot stomp may be varied depending on the user's footwear. When the user is wearing sneakers for example, the foot stomp creates a low frequency bass sound when the user stomps with his or her heel, and a high frequency treble sound when the user stomps with his or her toes. Additionally, the present disclosure provides an anti-tip ledge that keeps the instrument firmly on the ground when the user plays the instrument, no matter how vigorously. Lastly, the present disclosure enables the user to take apart the instrument, for example allowing him/her to replace parts as they wear out.

Specifically, the present disclosure claims a foot stomp percussion device comprising a housing that has a main portion and a ledge that extends beyond the main portion. The housing has two cavities, the first cavity having a larger depth and a larger area than the depth and area of the second cavity. The second cavity may contain a transducer (for example, a piezoelectric disc) that is electrically connected to one or more outputs coupled to the first cavity. The ledge extending beyond the main portion, which enhances stability, may be created by removing a segment from the top back side of the housing. The outputs coupled to the first cavity may include a potentiometer, an XLR output, and a quarter-inch output. The piezoelectric disc in the second cavity may be secured by a pressure pad, placed directly adjacent to the piezo disc. The two cavities may then be covered by a cavity control cover, which may be screwed into the bottom of the instrument. A pressure applicator may be screwed into the bottom of the instrument to allow the user to apply pressure to the transducer via the pressure pad. The instrument may have four rubber pedestals to keep it off the ground.

BRIEF DESCRIPTION OF THE DRAWINGS

The accompanying drawings, which are incorporated herein and form a part of the specification, illustrate the disclosure and, together with the description, further serve to explain the principles of the disclosure and to enable a person skilled in the pertinent art to make and use the disclosure. The disclosure is illustrated by way of examples, and not by way of limitation, in the figures of the accompanying drawings.

DETAILED DESCRIPTION

Embodiments of the present invention will now be described in detail with reference to the drawings, which are provided as illustrative examples so as to enable those skilled in the art to practice the embodiments. Notably, the figures and examples below are not meant to limit the scope to a single embodiment, but other embodiments are possible by way of interchange of some or all of the described or illustrated elements. Wherever convenient, the same reference numbers will be used throughout the drawings to refer to same or like parts. Where certain elements of these embodiments can be partially or fully implemented using known components, only those portions of such known components that are necessary for an understanding of the embodiments will be described, and detailed descriptions of other portions of such known components will be omitted so as not to obscure the description of the embodiments. In the present specification, an embodiment showing a singular component should not be considered limiting; rather, the scope is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the scope encompasses present and future known equivalents to the components referred to herein by way of illustration. Note that "stomp box," "foot stomp," and "instrument" are used interchangeably throughout the present disclosure. Furthermore, "musician," "stomper," and "user" are also used interchangeably throughout the present disclosure.

Figure 1A:
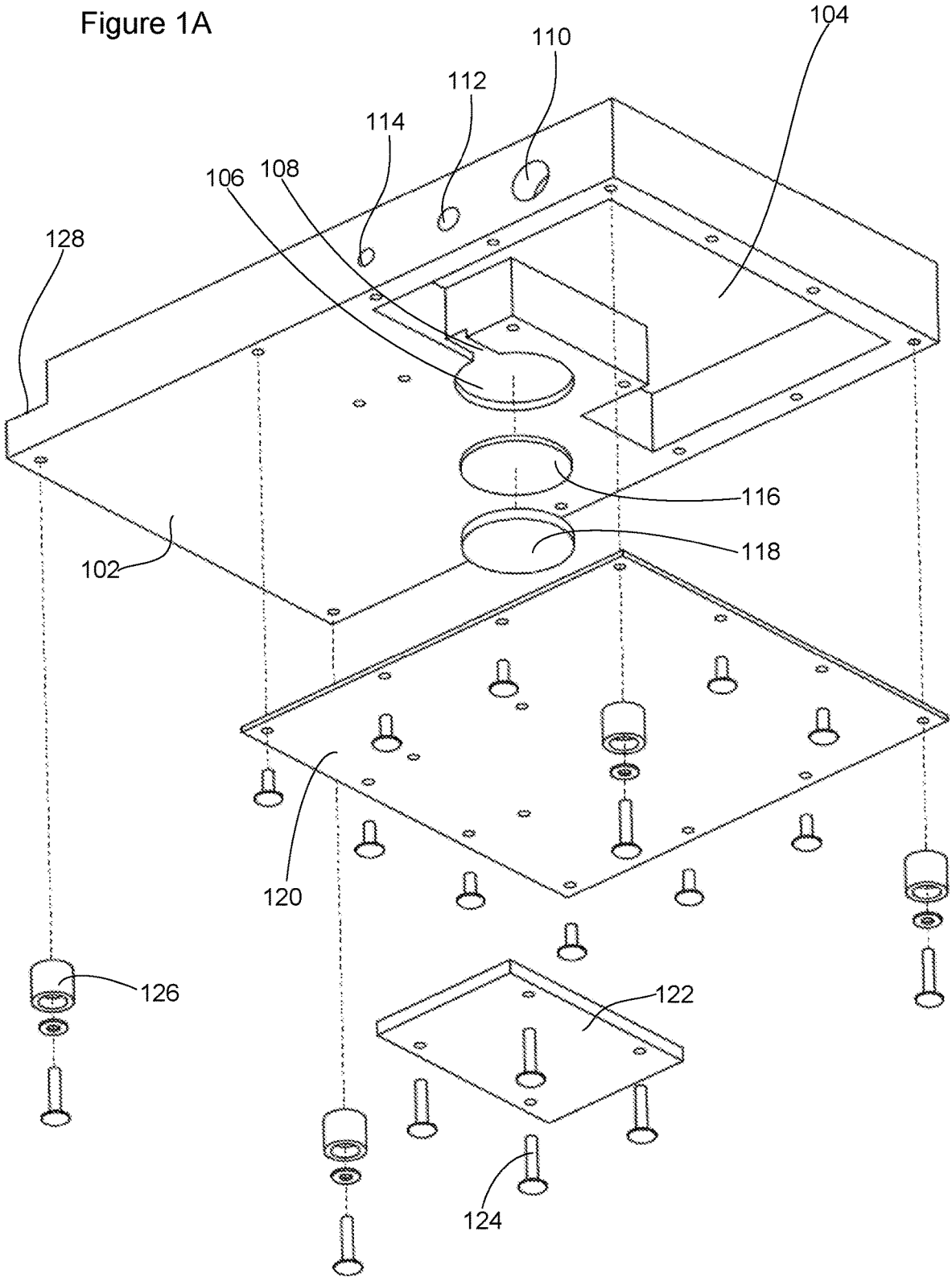
FIG. 1A illustrates a perspective view from the bottom of the foot stomp, showing each component separately, in accordance with embodiments of the disclosure.

FIG. 1A illustrates perspective view from the bottom of the foot stomp. The foot stomp described here comprises a box that includes a main portion containing two cavities, as well as a bottom ledge portion known as an anti-tip ledge. The housing or box (102) of the foot stomp may be a solid piece of wood, for example mahogany, from which two cavities (104, 106) are carved out within the main portion. The two distinct tones are created by the combination of the first cavity (104) and the solid portion of the housing (102). The first cavity (104) functions as the high frequency tone cavity, allowing for the instrument to produce a high frequency tone when stomped on by the user. The solid portion of the housing (102) functions as the low frequency tone block, allowing for the instrument to produce a low frequency tone when stomped on by the user. In other embodiments, the box may be made of material other than wood.

The first cavity (104) may be larger in area and/or volume than the second cavity. In one example, the first cavity can measure 7.5 inches long by 5.75 inches wide by 1.375 inches deep. Persons skilled in the art would appreciate that these dimensions, and other dimensions of components of the illustrative embodiments mentioned elsewhere, are not limiting to the scope of the disclosure. Additional dimensions of the stomp box are further described below. The second cavity (106) may be smaller in area and/or volume than the first cavity, and may be circular shaped. In one embodiment, the second cavity has a diameter measuring two inches. The second cavity (106) may have a small tunnel (108) to connect it to the first cavity (104). In one embodiment, the second cavity (106) can measure 0.1875 inches deep.

The second cavity (106) houses a transducer, which converts the pressure applied by the user to the transducer into an electrical signal. In one embodiment, the transducer is a piezo disc (116), ranging from 0.5 inches to 2 inches in diameter. A pressure pad (118) is disposed adjacent to the piezo disc (116). The pressure pad (118) may be made of a pliable material, e.g., foam rubber, for example 0.25 inches thick, and may be the same size as the second cavity, for example two inches in diameter. The pressure pad (118) may be made of a medium density rubber in order to avoid undue strain on the piezo which a hard density rubber might have caused.

A cavity control cover (120) covers the first and second cavities. The cavity control cover (120) may be made of rubber. The cavity control cover (120) may be screwed into the bottom of the foot stomp (102). A pressure applicator (122) is then attached the cavity control cover (120) to apply pressure to the piezo disc. The pressure applicator (122) may be screwed in using four screws (124). The pressure applicator (122) may be made of wood.

The foot stomp also includes an electrical component, which may transfer the electrical signal created by the transducer to an amplification system. In one embodiment, the electrical component comprises wiring going from the piezo disc to a volume potentiometer, an XLR output and a quarter-inch output. In one embodiment, the volume potentiometer and holes for the outputs are on the right-hand-side of the foot stomp, aligned with the first cavity. FIG. 1A shows three holes on the right-hand-size (110, 112, 114) going into the first cavity (104). The first hole (110) may be used for an XLR output. The second hole (112) may be used for a quarter-inch output. The third hole (114) may be used for a 1 Meg volume potentiometer. Other varieties of potentiometers and more or less number of outputs may be used.

In one embodiment, the foot stomp has four pedestals (126) attached to the bottom to keep it off the floor. The pedestals may be made of rubber, and the height of the pedestals dictates the separation between the pressure applicator (122) and the floor. The pedestals (126) may be screwed into the foot stomp housing (102). In some embodiments, some of the pedestals may be taller than the other pedestals to have the foot stomp rest at an angle.

In one embodiment, the inside surfaces of the first cavity (104) and the portion of the cavity control cover (120) that faces the inside of the first cavity may be coated with a conductive material in order to keep out outside electronic interference. For example, the inside of the first cavity (104) may be painted with nickel shielding paint. In another example, the backside of the cavity control cover (120), which faces the inside of the first cavity (104) when assembled, may be coated with copper shielding tape.

Figure 1B:
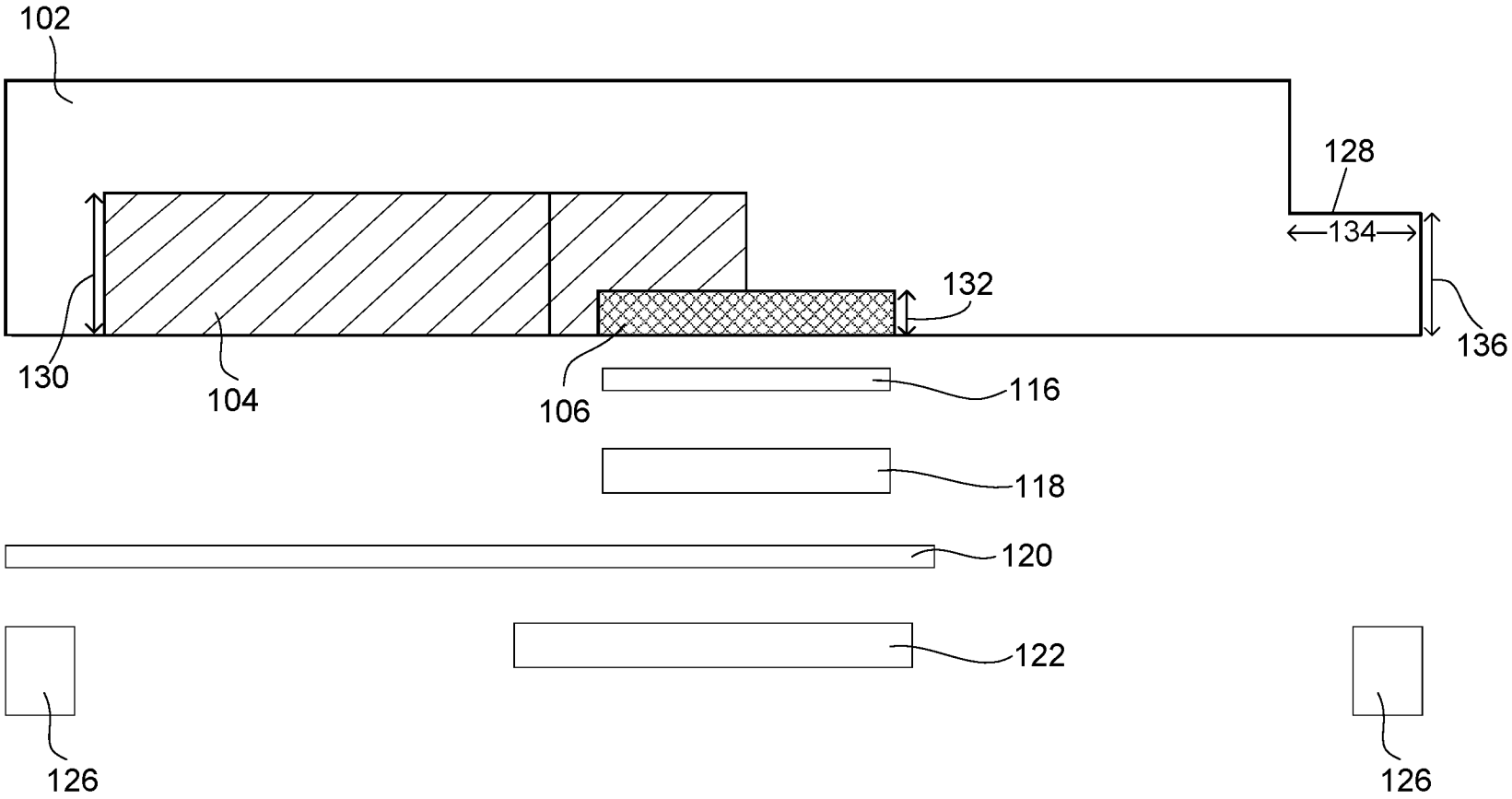
FIG. 1B illustrates a cross section of the foot stomp, showing each component separately, in accordance with embodiments of the disclosure.

FIG. 1B illustrates a cross-section of the foot stomp. The first cavity (104) is located near the front of the foot stomp, and may measure between 1 and 1.5 inches deep. For example, the first cavity (104) may measure 1.375 inches deep (130). The second cavity (106) is located near the middle of the foot stomp, so that it is under the user's arch of the foot when the user is playing the instrument. The second cavity (106) may measure 0.1875 inches deep (132). The first cavity (104) may overlap a portion of the second cavity (106) when seen from the bottom. The piezo disc (116) is placed directly into the second cavity (106). The piezo-on-wood contact creates a clear sound. The pressure pad (118) is then inserted adjacent to the piezo disc (116). The pressure pad (118) applies pressure to the piezo disc (116), ensuring a solid connection between the piezo and wood without using glue to permanently attach the piezo to the cavity. This enables the user to easily disassemble the foot stomp if the piezo is damaged and/or if a different type of piezo is required for tone control. Also, the piezo-to-wood contact materially affect the sound. The cavity control cover (120) is attached to the foot stomp housing (102). The cavity control cover (120) ensures that the electrical components in the first cavity (104) remain safe when the user moves the instruments. Finally, the pressure applicator (122) is attached to the cavity control cover (120). The pressure applicator (122) allows the user to apply more or less pressure to the piezo disc (116) via the pressure pad, giving the user control over the sound emitting of the stomp box. Applying more pressure to the piezo may create a clearer and stronger signal, which may create a crisper and clearer sound. The cavity control cover (120) and the pressure applicator (122) are screwed into the box, allowing the user to remove and replace any of the components as needed.

The stomp box has an anti-tip ledge (128), which enhances stability of the instrument when it is being played. The anti-tip ledge may be created by removing a segment, e.g. a strip of wood, from the top back edge of the foot stomp housing (102). In one embodiment, the ledge may be between 0.25 and 3 inches wide, and between 0.75 and 1 inch high. For example, the anti-tip ledge may measure 1 inch wide (134), and 0.875 inches high (136), which may mean that the segment removed measures one inch wide by one inch high. When played vigorously, the anti-tip ledge prevents the foot stomp from tipping upwards, which may interrupt the player's rhythm. Tipping of foot stomps during performance is a known problem in the field of music, which is solved by the design disclosed here.

Figure 2A:
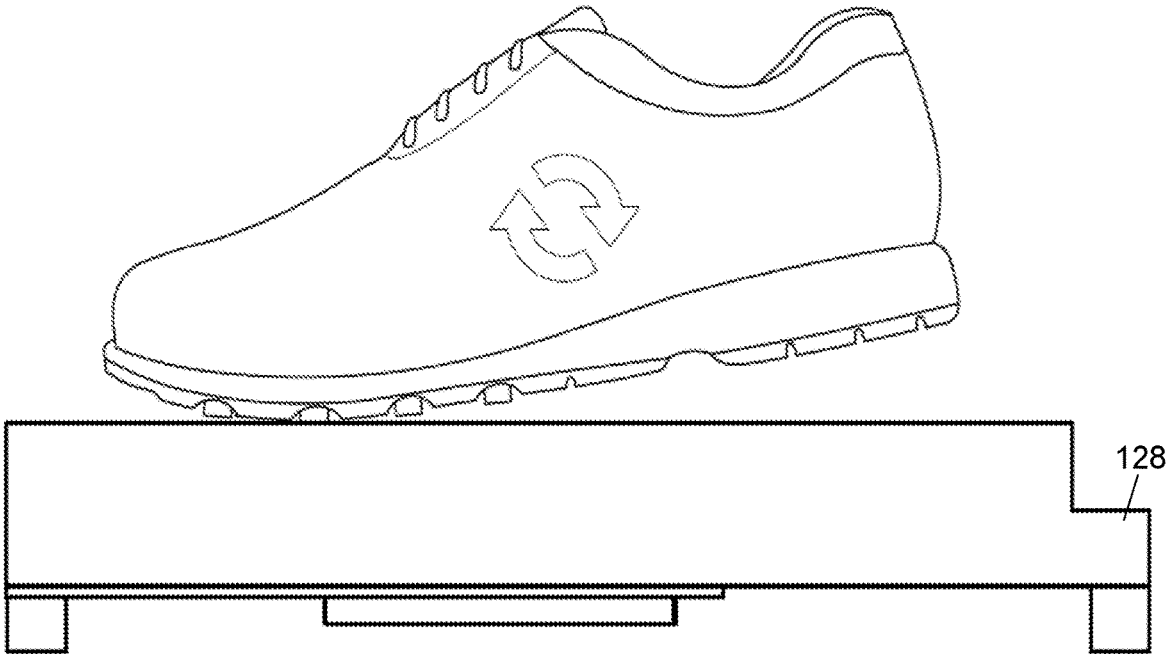
FIG. 2A and FIG. 2B illustrate position of a footwear worn by a user while playing the foot stomp, in accordance with embodiments of the disclosure.
Figure 2B:
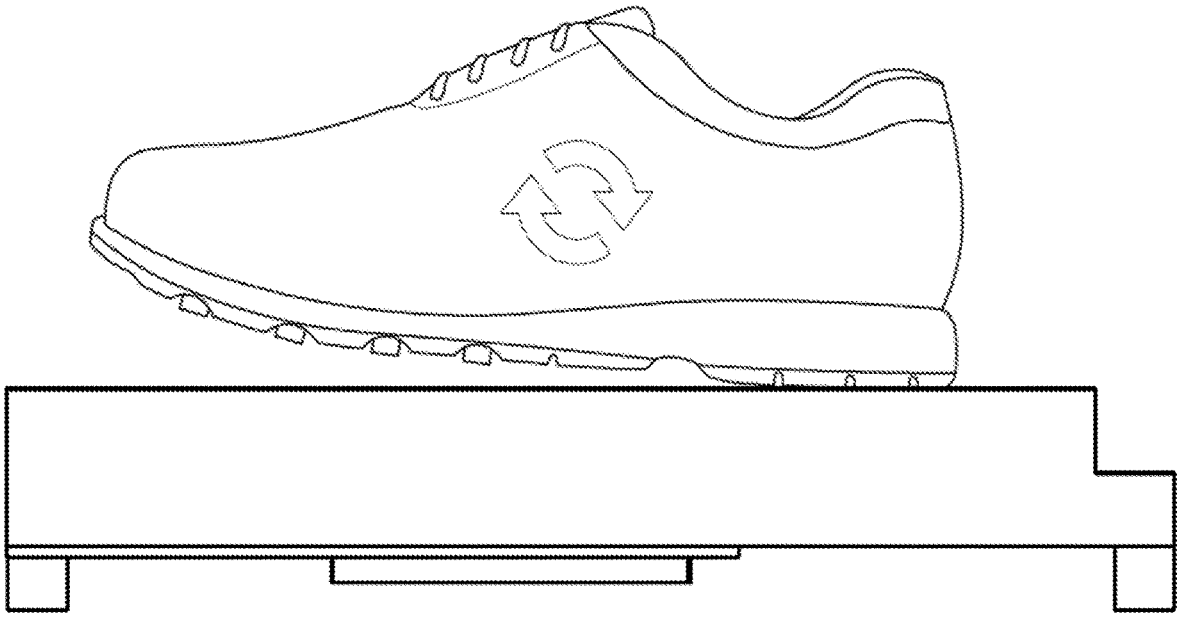

FIG. 2A and FIG. 2B illustrate how a user plays the foot stomp. The user places his or her foot on the top surface of the foot stomp, with the anti-tip ledge (128) facing toward the back. When the user stomps on the foot stomp, the pressure created by the user's stomp puts pressure on the piezo disc (116), which creates an electric current transferred to the output. When the user stomps using his or her toes, i.e. the user stomps on the front end of the foot stomp above the first cavity, as in FIG. 2A, the foot stomp may emit a high frequency treble tone. That is, when the user stomps on the front portion of the foot stomp, where the wood is thinner due to the presence of the large cavity, the piezo disc may pick up less pressure and hence may produce a quicker and lighter sound. When the user stomps using his or her heel, i.e. the user stomps on the back end of the foot stomp, where the wood is thicker (i.e., solid wood without any cavity), as in FIG. 2B, the piezo disc may pick up more pressure from the user's stomp and the foot stomp may emit a low frequency bass tone. The cavity under the user's toes creates the high frequency tone, and the solid piece under the user's heel captures the low frequency tone. These sounds may be altered based on the size of the user's foot, as well as the footwear worn by the user. For example, if the user is wearing wood-soled shoes, a toe stomp may emit a low frequency bass sound and a heel stomp may emit a high frequency treble sound.

Figure 3:
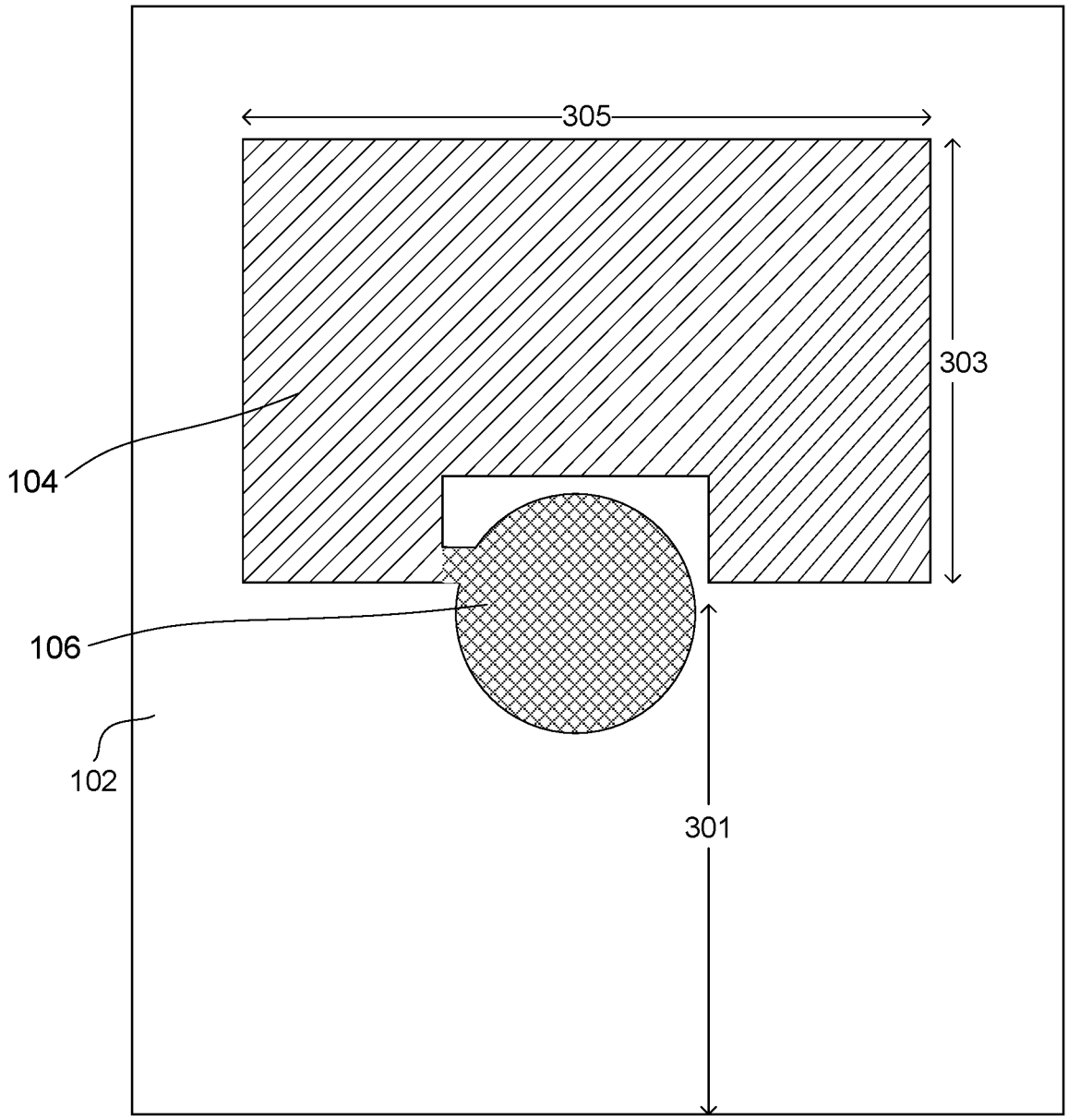
FIG. 3 is a bottom view of the foot stomp showing two cavities, with the removable components taken out, in accordance with embodiments of the disclosure.

FIG. 3 shows the bottom view of the foot stomp, with the piezo disc, the pressure pad, the cavity cover, and the pressure applicator removed. As described above in FIG. 1B, the first cavity (104) has a depth greater than the second cavity (106), measured from the bottom surface of the instrument. The first cavity (104) may measure between 6.5 inches and 8 inches wide, for example it may measure 7.5 inches wide (305). The first cavity (104) may measure between 4.75 inches and 6.75 inches long, for example it may measure 5.75 inches long (303). The closer the piezo disc is to the bottom of the foot stomp, the better the foot stomp will sound. The center of the piezo disc may be 5.25 inches from the back edge of the foot stomp (301). The different depths of the two cavities are shown with different patterns in FIG. 3.

Figure 4:
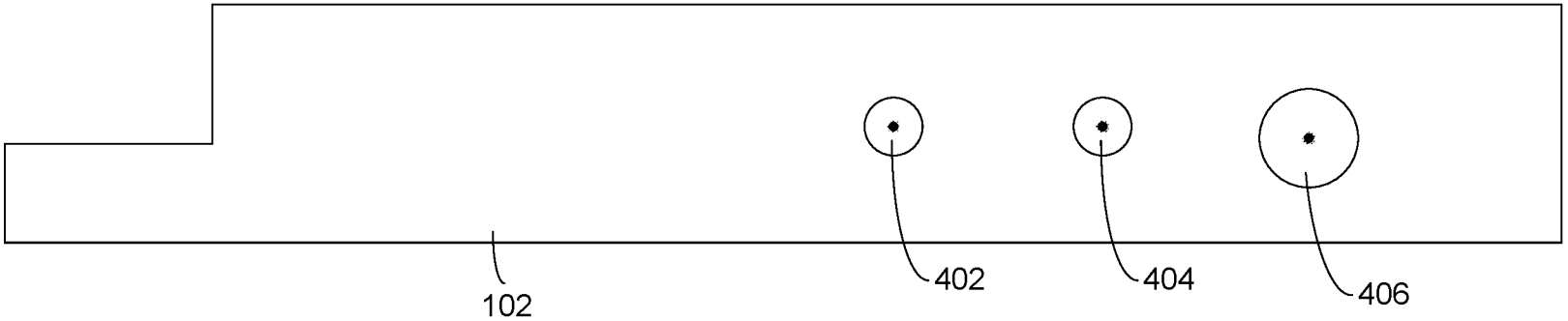
FIG. 4 illustrates a side-view of the foot stomp, in accordance with embodiments of the disclosure.
Figure 5:
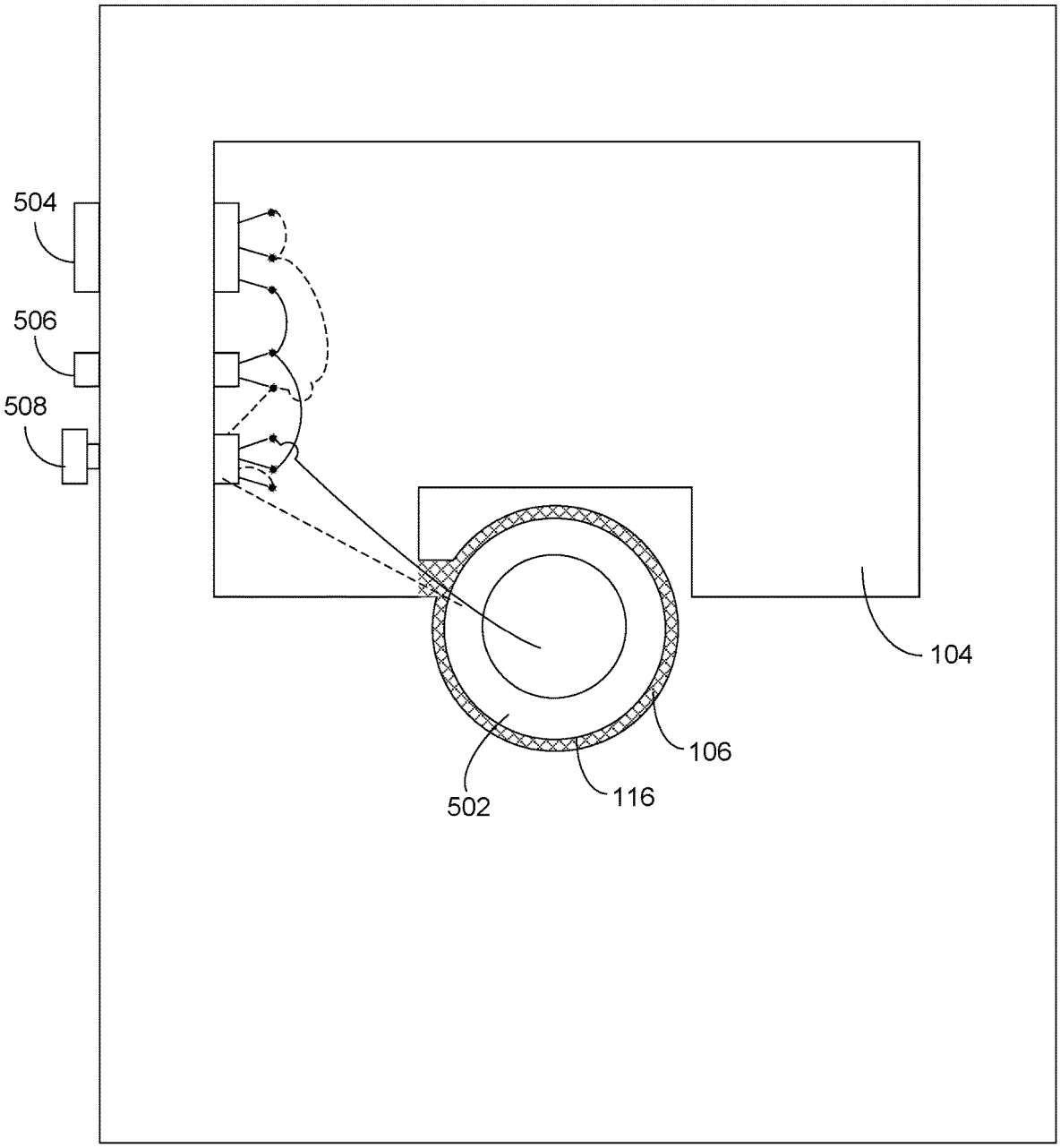
FIG. 5 illustrates a bottom view of the foot stomp, with the piezo disc and electrical circuits visible, in accordance with embodiments of the disclosure.

FIG. 4 illustrates the right-side view of the foot stomp (102). In one embodiment, the right-side has three holes to connect to the output. Other embodiments may have more or fewer holes depending on the electrical outputs chosen. The first hole (402) may be used to connect to an XLR output, for example. The holes may be aligned with the first cavity (104, not pictured in FIG. 4). The second hole (404) may be used to connect to a quarter-inch output, for example. The third hole (406) may be used to connect a 1 Meg potentiometer, for example FIG. 5 illustrates the electrical circuits used in an embodiment of the disclosure. The piezo disc (116) is enclosed in the second cavity (106). The piezo disc (116) has a metal outer plate (502) that works as the ground. In one embodiment, the piezo disc (116), the XLR output (504), and quarter-inch output (506) are grounded to the potentiometer (508), as is illustrated in FIG. 5 using the dotted lines. In another embodiment, the elements may be grounded to a metal screw in the foot stomp (not illustrated). The solid lines connecting the terminals of the XLR output (504), the quarter-inch out (506), and the potentiometer (508) in FIG. 5 illustrate the path of electrical current created by the piezo transducer (116), connected to the potentiometer (508), the quarter-inch output (506), and the XLR output (504). The circuitry is housed in the first cavity (104) of the foot stomp.

Figure 6:
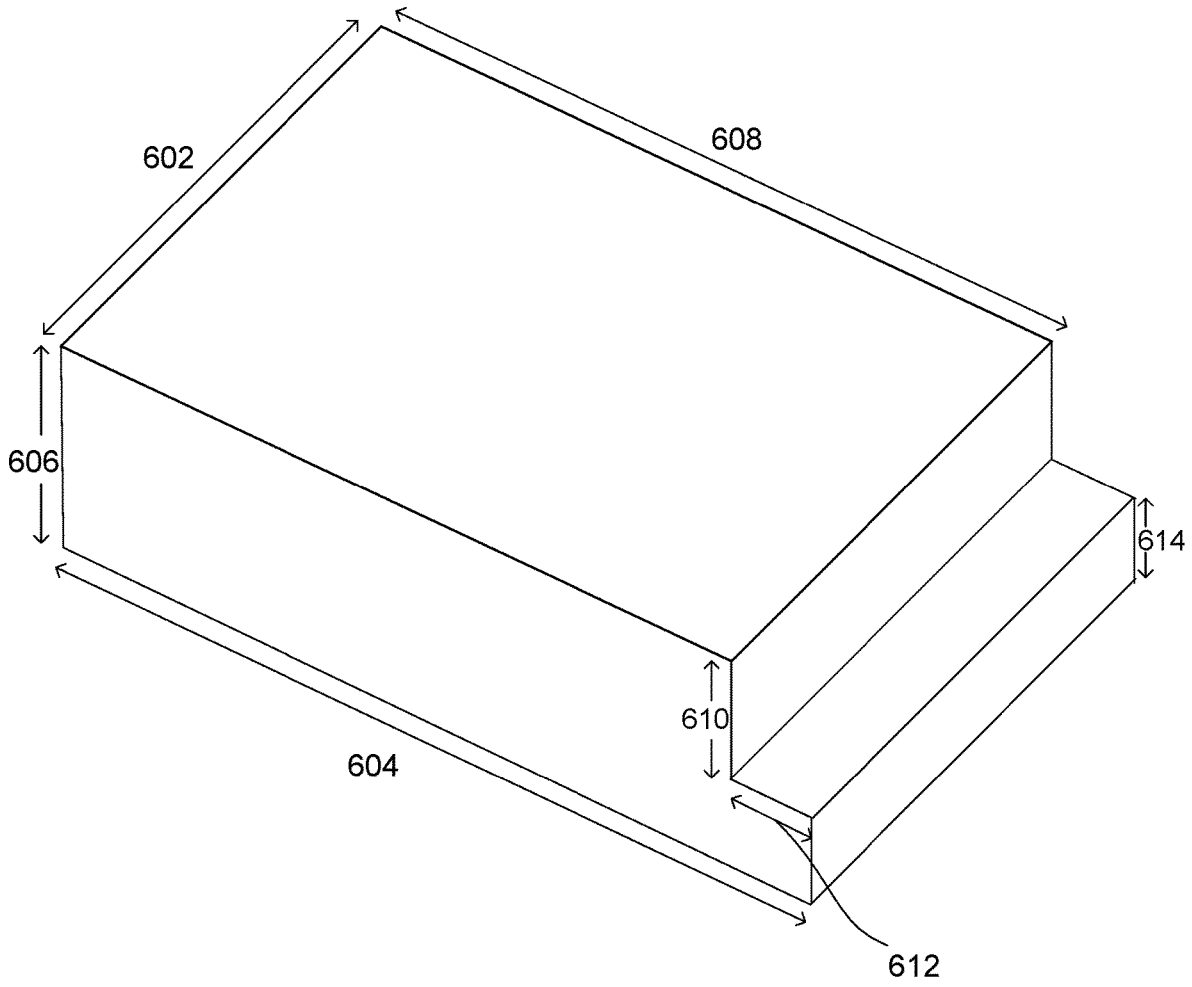
FIG. 6 is a front perspective view of the foot stomp, in accordance with embodiments of the disclosure.

FIG. 6 illustrates a top perspective view of a foot stomp. In one embodiment, the foot stomp is a solid box made of wood, such as mahogany. Other types of wood, such as maple, birch, or even plastic or cast metal can be used as the material of the foot stomp, though the sound quality may vary. The foot stomp may measure between 7.5 and 9.5 inches wide (602). The foot stomp may measure between 1.5 inches and 2 inches high (606). The foot stomp may measure between 10 inches and 15 inches long (604). The top portion of the foot stomp (608) may measure between 9 and 14 inches long. The anti-tip ledge may measure one inch from the top of the box (610). The anti-tip ledge may extend from the box (612) by between 0.25 inches to 3 inches. Furthermore, the anti-tip ledge may measure between 0.75 and 1 inch high (614).

The words "example" or "exemplary" are used herein to mean serving as an example, instance, or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." In addition, the articles "a" and "an" as used in this application and the appended claims should generally be construed to mean "one or more" unless specified otherwise or clear from context to be directed to a singular form.

Reference throughout this specification to "one embodiment" or "an embodiment" means that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment.

The above description is intended to be illustrative and not restrictive. For example, the above-described examples (or one or more aspects thereof) may be used in combination with each other. Other implementations can be used, such as by one of ordinary skill in the art upon reviewing the above description. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed implementation. Thus, the following claims are hereby incorporated into the Detailed Description, with each claim standing on its own as a separate implementation, and it is contemplated that such implementations can be combined with each other in various combinations or permutations. The scope of the implementations of the disclosure should be determined with reference to the appended claims, along with the full scope of equivalents to which such claims are entitled.

In the drawings, which are not necessarily drawn to scale, like numerals may describe similar components in different views. Like numerals having different letter suffixes may represent different instances of similar components. The drawings illustrate generally, by way of example, but not by way of limitation, various implementations discussed in the present document.

What is claimed is:

1. A foot stomp percussion device comprising:

a housing comprising a main portion and a bottom ledge portion that extends beyond the main portion, wherein the bottom ledge portion of the housing is created by removing a segment from the housing in order to enhance stability;

a first cavity within the main portion of the housing, wherein the first cavity has a first depth measured from a bottom of the housing; and a second cavity within the main portion of the housing, wherein the second cavity has a second depth measured from the bottom of the housing;

wherein the first depth is greater than the second depth;

wherein the second cavity is connected to the first cavity; and wherein the second cavity contains a transducer which is electrically connected to one or more outputs coupled to the first cavity.

2. The foot stomp percussion device of claim 1, wherein the device emits a low frequency bass sound when a user applies pressure to a top back portion of the housing, wherein the back portion of the housing comprises a solid piece.

3. The foot stomp percussion device of claim 2, wherein the user applies pressure to the top back portion of the housing using his or her heel.

4. The foot stomp percussion device of claim 1, wherein the device emits a high frequency treble sound when a user applies pressure to the first cavity by stomping on a top front portion of the housing with his or her toes, wherein the front portion of the housing comprises the first cavity.

5. The foot stomp percussion device of claim 1, wherein the transducer is a piezoelectric disc.

6. The foot stomp percussion device of claim 1, wherein an area of the first cavity is greater than an area of the second cavity.

7. The foot stomp percussion device of claim 1, wherein a volume of the first cavity is greater than a volume of the second cavity.

8. The foot stomp percussion device of claim 1, wherein the segment is removed from a top back side of the housing.

9. The foot stomp percussion device of claim 1, wherein electrical circuitry within the first cavity connects the transducer to a potentiometer, which is further connected to the one or more outputs.

10. The foot stomp percussion device of claim 9, wherein the outputs comprise an XLR output and a quarter-inch output.

11. The foot stomp percussion device of claim 1, wherein the second cavity further contains a pressure pad adjacent to the transducer.

12. The foot stomp percussion device of claim 11, wherein the pressure pad is made of rubber.

13. The foot stomp percussion device of claim 11, wherein the first cavity and the second cavity are covered by a cavity control cover.

14. The foot stomp percussion device of claim 13, wherein the cavity control cover is made of rubber.

15. The foot stomp percussion device of claim 13, wherein the cavity control cover is screwed into the bottom of the housing.

16. The foot stomp percussion device of claim 13, wherein the cavity control cover is coated with a conductive material.

17. The foot stomp percussion device of claim 13, wherein a pressure applicator is made of wood, and wherein the pressure applicator is screwed into the cavity control cover in order to put pressure on the transducer via the pressure pad.

18. The foot stomp percussion device of claim 1, wherein four rubber pedestals are attached to the bottom of the housing.

19. The foot stomp percussion device of claim 1, wherein the first cavity is coated with a conductive material.

* * * * *